United States Patent [19]

Arszman

[11] Patent Number: 4,949,918

[45] Date of Patent: Aug. 21, 1990

[54] MOMENT CONTROL OF ROCKETS

[76] Inventor: Jerrold H. Arszman, 4211 Huntington Rd., Huntsville, Ala. 35802

[21] Appl. No.: 401,195

[22] Filed: Aug. 2, 1989

[51] Int. Cl.[5] ..... F41G 7/00

[52] U.S. Cl. ..... 244/3.22; 239/265.19; 244/3.21; 244/3.24

[58] Field of Search ..... 244/3.22, 3.21, 3.24; 239/265.19

[56] References Cited

U.S. PATENT DOCUMENTS

| | | | |
|---|---|---|---|
| 2,824,711 | 2/1958 | Porter | 244/3.21 |
| 2,898,856 | 8/1959 | Lightbody et al. | 102/377 |
| 2,946,285 | 7/1960 | Nauschutz et al. | 244/3.24 |
| 3,233,848 | 2/1966 | Byrne | 244/3.14 |
| 3,262,645 | 7/1966 | Veno | 239/265.19 |
| 4,327,885 | 5/1982 | Blevins et al. | 244/3.24 |
| 4,562,980 | 1/1986 | Deans et al. | 244/3.22 |

*Primary Examiner*—Charles T. Jordan
*Assistant Examiner*—Rochelle Lieberman

[57] ABSTRACT

A rocket that includes a center body with a system center of gravity and rocket motor means mounted relative to the center body and reaction surfaces for causing a resultant force from thrust of the rocket motor means to direct the resultant force through the system center of gravity of the center body.

5 Claims, 2 Drawing Sheets

MOMENT CONTROL OF ROCKETS

DEDICATORY CLAUSE

The invention described herein may be manufactured, used, or licensed, by or for the Government for governmental purposes without the payment to me of any royalties thereon.

BACKGROUND OF THE INVENTION

In the past, rockets in general have been symmetric and produced thrust that acted through the center of gravity (cg) of the rocket. There are other missile arrangments where a plurality of rockets are clustered around a center body payload. In such a clustered configuration, the resultant thrust of the cluster goes through the center of gravity of the system only if the geometry of the cluster is symmetric, the thrust from each population unit is identical, or the cluster has some unusual combination of geometric assymmetry and individual thrust variations results in a net thrust misalignment of zero. If traditional symmetric propulsion units are used in this clustered arrangement, then inherent variations, both geometric and individual unit thrust, will cause a moment to be induced into the missile. These moments can quickly cause system performance degradation. There are a number of approaches to reducing these moments and most rely on directing the axial motor thrust, of the individual propulsion unit through the center of gravity of the system. These approaches reaim the motor axial thrust so that it passes through the system center of gravity either by canting the entire motor or by canting only the rocket motor nozzle. The down side of this reaiming is a reduction of the propulsion unit thrust along the missile system center line and a resulting overall performance loss that is directly proportional to the cosine of the cant angle. Therefore, there is a need to overcome some of the faults of the prior arrangments.

Accordingly, it is an object of this invention to provide a missile arrangement that has a center body payload with a plurality of rockets secured around the payload and having means for causing the thrust of the rocket to go through the center of gravity of the missile system without degradation of the motor axial thrust.

Another object of this invention is to provide a center body payload with a plurality of rockets symmetrically arranged around the payload with the axis of each of the rockets being parallel to the axis of the center body payload and with the thrust from each rocket being directed through the center of gravity of the missile system.

Other objects and advantages of this invention will be obvious to those skilled in this art.

SUMMARY OF THE INVENTION

In accordance of this invention, a missile arrangement is provided in which axial motor thrust of a rocket motor and moment control forces are chosen such as to cause the resultant force of these to be directed through the center of gravity of the missile system.

DESCRIPTION OF THE PREFERRED EMBODIMENT

Figure 1:
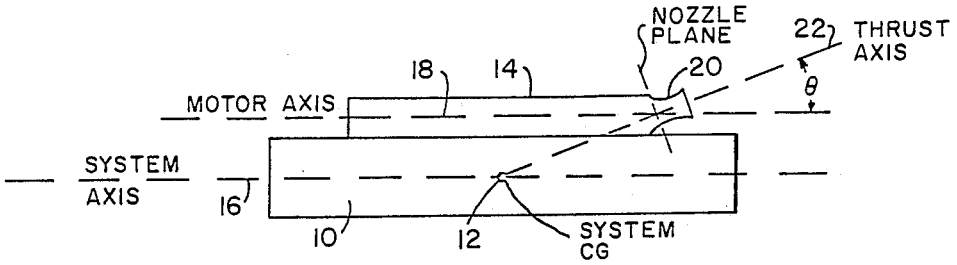
FIG. 1 PRIOR ART
FIG. 1 is a schematic of a payload system with a canted nozzle for directing resultant force of the rocket motor through the center of gravity of a payload.

Referring now to the drawings, the prior art illustrated in FIG. 1 includes a payload 10 with a system center of gravity 12 and a rocket motor 14 mounted at one side of payload 10. Payload 10 has a central axis 16 and motor 14 has a motor axis 18. Rocket motor 14 has a canted nozzle 20 that is canted to produce a thrust axis 22 for causing the thrust from rocket motor 14 to be through the center of gravity 12 of payload 10. As illustrated, canted nozzle 20 is canted by an angle $\theta$ as illustrated to cause the thrust from rocket motor 14 to be directed along thrust axis 22.

Figure 2:
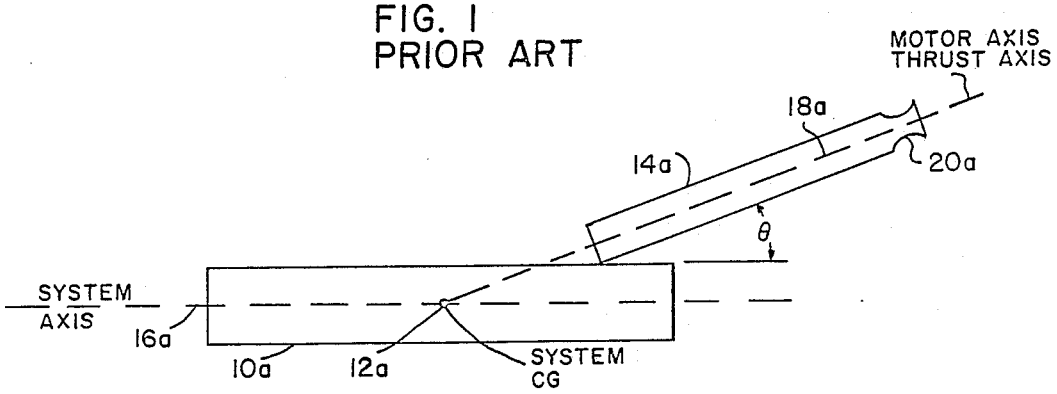
FIG. 2 PRIOR ART
FIG. 2 is a schematic illustration of the mounting of a rocket motor relative to a payload such that the force of the motor is projected through the center of gravity of the payload.

Referring now to FIG. 2, this prior art arrangement includes a payload body **10*a* that has a system center of gravity 12*a* with a system axis 16*a* and a rocket motor 14*a* secured at one side of payload 10*a* at an angle $\theta$ as illustrated. Rocket motor 14*a* has a conventional nozzle 20*a* for exhausting along the motor axis and thrust axis 18*a* . By mounting rocket 14*a* as illustrated, the thrust from rocket motor 14*a* is directed through the system center of gravity 12*a*** as illustrated.

Figure 3:
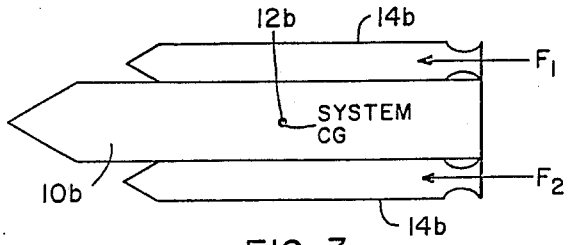
FIG. 3 is a schematic illustration of a center payload body with rocket motor symmetrially mounted there around.
Figure 4:
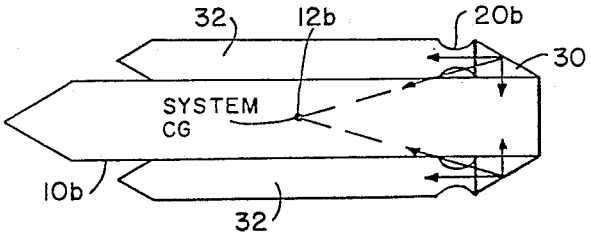
FIG. 4 is a schematic illustration of a center payload with a plurality of rockets symmetrically mounted relative thereto and having reaction surfaces for causing resultant forces to be directed through the center of gravity of the missile system.
Figure 5:
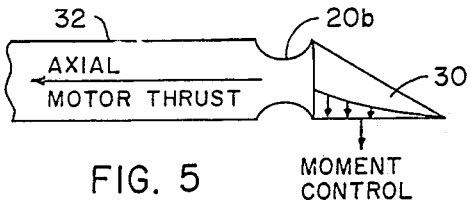
FIG. 5 is a schematic illustration of a rocket motor and nozzle with a scarfed nozzle extension.

Referring now to FIG. 3, in this configuration, a plurality of rocket motors **14*b* are clustered around center body 10*b* that has a system center of gravity 12*b*. In this arrangment with motors 14*b* equally spaced around center body 10*b*, if forces $F_1$ and $F_2$ as illustrated are not equal, then a turning moment is present around the system center of gravity 12*b* which is not desirable. To overcome this problem and to still obtain the full force from each rocket motor, rocket motor nozzle 20*b* (see FIG. 4) has a scarfed nozzle extension 30 that produces forces from the gases exhausting the nozzle which forces are perpendicular to the thrust from the rocket motor. As illustrated in FIGS. 4 and 5, from the axial thrust of the rocket motor and from the scrafed nozzle 30, the forces produced result in a resultant force that is directed through the system center of gravity 12*b* for each of rockets 32. That is, by adding scarfed nozzle extension 30 onto each rocket motor nozzle 20*b*, the resultant force from each rocket can be presented through the system center of gravity 12*b* and the thrust or forces produced by each rocket motor does not have to be identical to that of the other rocket motor to prevent turning moments relative to the system center of gravity 12***b* of center payload 10*b*. Each rocket motor 32 with scarfed nozzle extension 30 is selected such that the resultant force of each rocket motor is directed through the system center of gravity 12*b*. This prevents or minimizes any turning moments relative to the overall missile structure.

Figure 6:
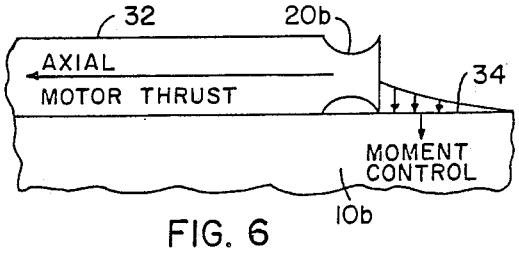
FIG. 6 is a schematic illustration of a rocket motor and a payload body that has a reaction surface.
Figure 7:
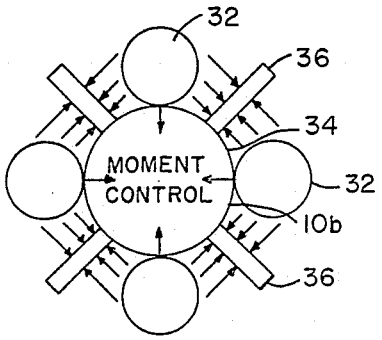
FIG. 7 is an end view of a payload body that has fins and rocket motors that utilize the payload body and fins as reaction surfaces.
Figure 8:
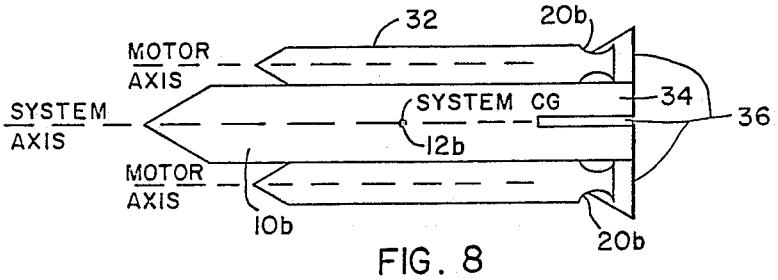
FIG. 8 is a side view of the missile arrangement illustrated in FIG. 7.

Referring now to FIGS. 6, 7, and 8, in some applications, scarf nozzle extension 30 may not be desirable and it may more desirable to use the surface of the center body itself as well as the other surfaces on the center body. In FIG. 6, forces from the exhaust gases of rocket motor 32 act on center body 10*b* at the rear end where center body 10*b* extends beyond the end of rocket motor nozzle 20*b* at extended portion 34. The forces directed against the outer surface of extended portion 34 can be utilized with the thrust forces from the motor to produce a resultant force that is directed through the system center of gravity. In FIG. 7, not only do the exhaust gases exert force on rear section 34 but also on fins 36 that are a part of the center body. This illustrates another way in which greater forces can be achieved from surfaces on the center body. The arrangement illustrated in FIG. 8 is a side view of center body 10*b* with a plurality of rocket motors 32 equally spaced around the periphery of center body 10 with a rear extending section 34 and fins 36. In this arrangement, the resultant force from gases exhausting through nozzles 20*b* produce a resultant force with the forces acting on rear section 34 and fins 36 to direct the resultant force through the center of gravity 12*b*. It will be appreciated that the maximum amount of thrust from rocket motors 32 is utilized by rocket motors 32 having a central axis that is parallel to the central axis of center body section 10*b*. With an arrangement of this type as illustrated in FIGS. 4 through 8, greater thrust from the rocket motors is obtained than from the prior art arrangements illustrated in FIGS. 1 and 2.

Figure 9:
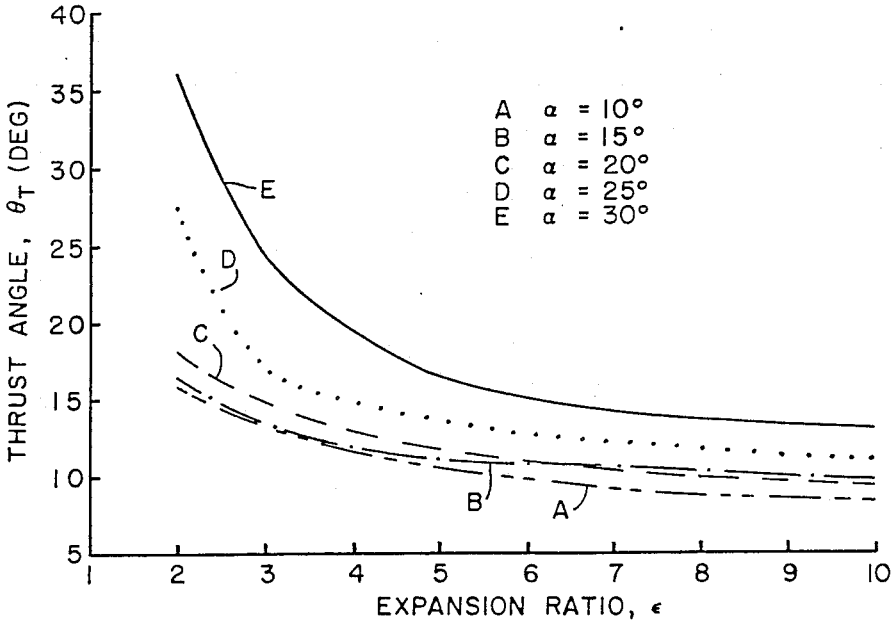
FIG. 9 is a graph illustrating the amount of control available using scarfed nozzles.

FIG. 9 is provided to show the amount of control in thrust turning that can be achieved utilizing scarf nozzle extensions on a regular rocket motor nozzle. Similar type curves are producible for the center body extension and the fin reaction surfaces.

In operation, this invention uses the residual energy of the population unit exhaust gases of the rocket motors after the normal expansion process is complete. By allowing the gas expansion to proceed in a nozzle that is aligned to the motor geometric axis and parallel to the center body axis, there is no motor axis thrust lost as with a canted nozzle as illustrated in FIG. 1 or a canted motor as illustrated in FIG. 2. The exhaust gases from rocket motors 32 react on aft-surfaces 34 and 36 or scarf nozzle extensions 30 to produce a moment without affecting axial thrust output. With motors 32 clustered around center body 10*b*, inherent variations in the axial thrust of each rocket motor 32 is compensated for by adding scarfed extensions 30 or by surfaces 34 and 36 which cause a counter moment to be established so that the resultant thrust vector of each motor 32 passes through the systems center of gravity 12*b*. Using these arrangements, the induced amount of the clusterd motors 32 around the system center of gravity 12*b* is minimized.

The theory of operation is the same by directing the resultant force through the system center of gravity 12*b* whether scarfed extension nozzles 30 are used or where surfaces 34 and/or 36 are used. In each of these applications, significant moment control is obtained. The degree of moment control is a 3 dimensional analytical problem, but the analysis is easily performed for the amount of control achievable by using scarfed nozzles. That is, as illustrated in FIG. 9, the amount of control available using scarfed nozzles is well within the range of normal design practice. Effective thrust turning of up to 30 degrees can be achieved. With proper selection, center body surfaces 34 and/or 36 can produce similar results.

I claim:

1. A rocket comprising a center body section with a system center of gravity at an axis of the center body, a rocket motor mounted at the periphery of said center body and having an axis that is parallel to the axis of said center body, said rocket motor having an exhaust nozzle that exhausts axially along the axis of said rocket motor, and means mounted in a permanently fixed and stationary position beyond an exit end of the exhaust nozzle and forming a reaction surface so that a resultant force from thrust of the rocket motor is produced which resultant force is continuously directed through the system center of gravity of said center body.

2. A rocket as set forth in claim 1, wherein said center body has a plurality of said rocket motors mounted around the periphery thereof with said rocket motors being equally spaced and with a fixed reaction surface for each motor which causes a resultant force from each motor to be continuously directed through the system center of gravity of said center body.

3. A rocket as set forth in claim 2, wherein said reaction surfaces for said rocket motors are scarfed nozzles that are attached to an expansion nozzle portion of the exhaust nozzle.

4. A rocket as set forth in claim 2, wherein said reaction surfaces are surfaces on said center body.

5. A rocket as set forth in claim 4, wherein said reaction surfaces are surfaces at a rear end of said center body and fins equally spaced around the periphery of said center body at said end.

* * * * *